United States Patent [19]

Wadsworth et al.

[11] 4,169,398

[45] Oct. 2, 1979

[54] FILAMENT CUTTING

[75] Inventors: Cyril Wadsworth; Horace E. Amstell, both of Harrogate, England

[73] Assignee: Imperial Chemical Industries, Inc., Great Britain

[21] Appl. No.: 876,388

[22] Filed: Feb. 9, 1978

Related U.S. Application Data

[63] Continuation of Ser. No. 724,193, Sep. 17, 1976, abandoned.

[30] Foreign Application Priority Data

Sep. 18, 1975 [GB] United Kingdom ..... 38409/75

[51] Int. Cl.[2] ..... D01G 1/04

[52] U.S. Cl. ..... 83/346; 83/98; 83/913

[58] Field of Search ..... 83/913, 24, 27, 37, 83/98, 108, 161, 164, 165, 346, 347, 331

[56] References Cited

U.S. PATENT DOCUMENTS

| | | | |
|---|---|---|---|
| 3,733,945 | 5/1973 | Cook | 83/24 |
| 3,796,119 | 3/1974 | Fox | 83/346 |
| 3,831,481 | 8/1974 | Van Doorn et al. | 83/913 X |
| 3,834,263 | 9/1974 | Smith | 83/346 |
| 3,985,053 | 10/1976 | Kayser et al. | 83/346 X |

*Primary Examiner*—Frank T. Yost

*Attorney, Agent, or Firm*—Robert J. Blanke

[57] ABSTRACT

Process and apparatus for cutting filamentary material using apparatus comprising a reel fitted with a plurality of spaced outwardly facing knife blades against which the material to be cut is wound and then severed by applied pressure, wherein entanglement of cut fibre is reduced or obviated by impingement against a divergent surface attached to and rotating with the cutter reel.

3 Claims, 1 Drawing Figure

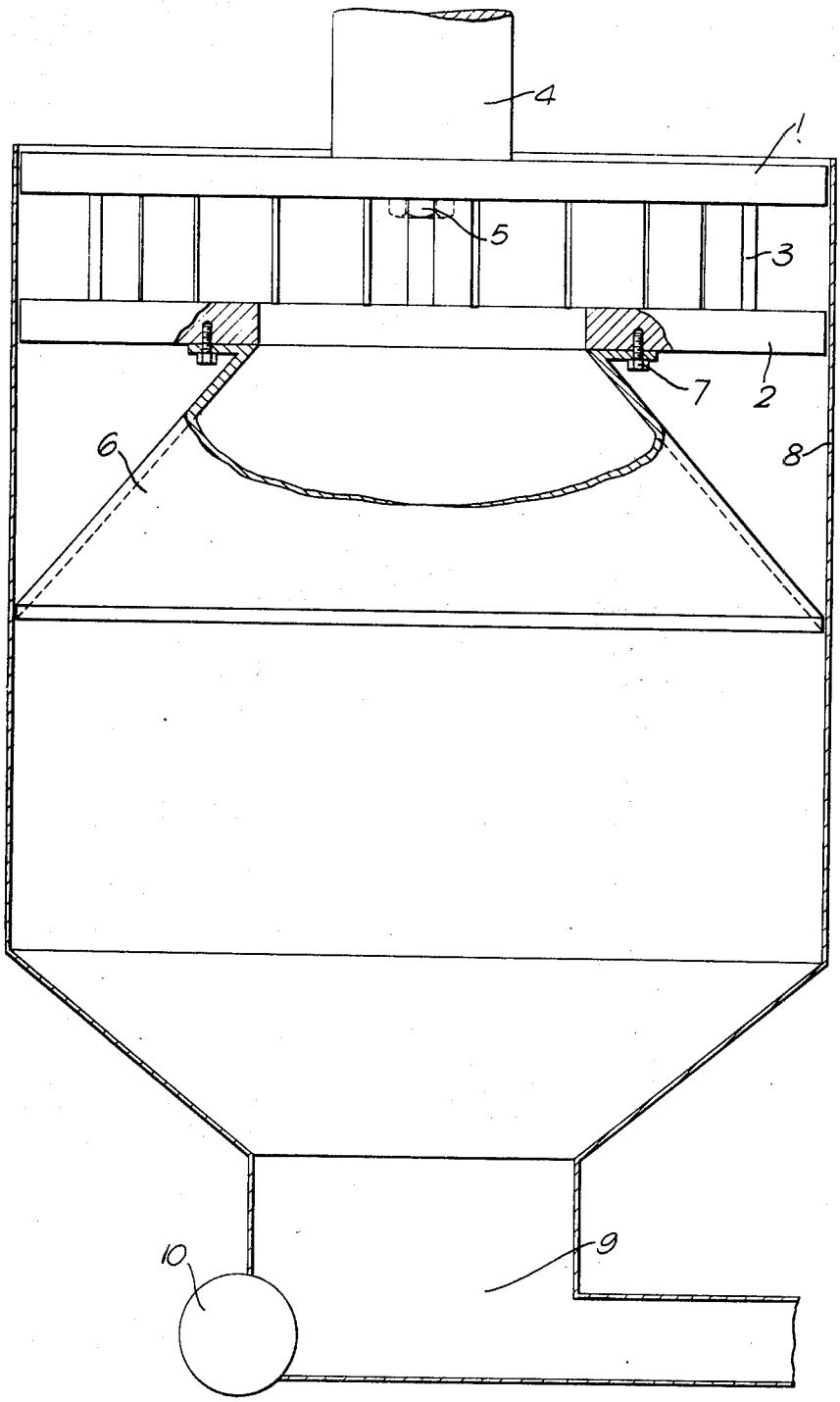
4
1
5
3
7
2
6
8
10
9

FILAMENT CUTTING

This is a continuation of application Ser. No. 724,193, filed Sept. 17, 1976, now abandoned.

This invention relates to a method and apparatus for cutting continuous filamentary material into shorter lengths and in particular for removing cut lengths from the cutting region so as to substantially eliminate or reduce any tendancy for cut lengths to adhere together in rope-like form.

A cutting device which was a major advance in the art is described in United Kingdom Pat. No. 1 204 363, wherein the filaments are continuously wound onto a reel carrying a plurality of outward facing spaced knife blades and a steadily increasing pressure of the filaments against the blades is built up until the inner layers are severed and the cut lengths pass between the knife blades and fall through the reel into a collecting chute. While this device offered much improved cutting performance it introduced a new problem in that by reason of the compression of the filaments in successive wraps around the reel before and during cutting there is a tendancy for the fibres of a cut length to clump together either within a cut bundle or between successive bundles in a rope-like form. Various remedies have been proposed to cure such faults as for example methods described in United Kingdom Pat. Nos. 1 340 655 and 1 400 136 wherein either a jet of air is impinged upon the back of the reel to remove cut lengths as they form and to open the fibre bundles or the tow of filaments prior to being wrapped about the cutter reel is treated so as to dephase the crimp in the filaments comprising the tow. These remedies have been effective in preventing some clumping faults but the formation of rope-like groups of cut lengths may still occur sometimes, particularly with certain synthetic filaments such as nylon 66 filaments.

We have now found that a simple modification of the cutting apparatus is an effective means of obviating clumping faults especially clumping of cut lengths into rope-like form.

Thus according to this invention we provide a process for cutting continuous filamentary material into shorter lengths comprising continuously wrapping the material under tension around the periphery of a rotating reel carrying a plurality of outward facing spaced knife blades, cutting the material of the inner wraps by radial pressure of the filaments against the blades and impinging the cut material passed through the spaces between the blades against the inner side of a divergent surface depending from the reel and rotating therewith, the cut material falling from the rotating surface into a collecting or conveying means.

A preferred apparatus for carrying out the invention comprises a substantially circular assembly of spaced outwardly facing knife blades secured to a reel having upper and lower knife mounting members the lower member being apertured for passage of cut filamentary material, means to rotate the reel and to continuously wrap successive layers of filamentary material around the reel against the knife blades, means exerting radial pressure on the wrapped material at at least one point and a divergent surface attached around the periphery of the aperture in the lower mounting member depending therefrom and rotating therewith. The reel of a preferred apparatus is mounted to rotate in a substantially horizontal plane. Other orientations of the plane of rotation, up to the vertical, may also be used.

In practice the upper knife mounting member of a commercially produced cutter according to UK Pat. No. 1 204 363 is a disc attached at its centre to the drive shaft of a suitable electric motor and the lower knife mounting member is an annular ring through which cut lengths of filaments fall towards the collecting or conveying means. The surface receiving cut filamentary material is attached to the lower mounting member and depends therefrom thus in effect providing an extension of the central opening in this member. The whole reel is encased by a generally cylindrical wall to confine the cut material and direct it to the collecting or conveying means the wall being provided with suitable doors for access inside and/or transparent portions for inspection of the operation of the cutter. The surface depending from the cutter reel may have various forms, as for example a frustum of a right circular or waisted cone or of a pyramid, or a short cylindrical portion followed by a conical portion or vice versa, all forms being open at the lower end to allow cut filamentary material to fall away to collecting or conveying means. It is preferred to employ a form of impingement surface which diverges from its point of attachment to obviate the possibility of accumulation of cut fibre which may otherwise occur within the boundary of any non-divergent portion of the surface, particularly if the lower opening from the surface is of limited aperture. Such tendancy to accumulate cut fibre may lead to some undesirable entanglement of the cut material or even to actual blockage of the apparatus, a divergent impingement surface is effective in preventing the formation of rope-like entanglements of cut fibre by reason of the positive tensioning and breaking up of incipient such entanglements produced by the combined effects of gravity and centrifugal forces acting at the diverging surface.

A simple and preferred shape for the impingement surface is a hollow divergent frustum of a cone the upper opening in which corresponds to the opening in the annular lower reel member to which it is attached. In operation of this modification the cut material passing through the spaces between the knife blades enters the opening in the lower reel member and is drawn by centrifugal force and the movement of air encased within the apparatus against the inner surface of the divergent cone where the possibility for tangling of cut filament bundles with each other is reduced due to the forces operating. Bundles already lightly tangled into a rope-like form tend to be separated into individual bundles before leaving the lower edge of the conical surface under the influence of gravity and dropping into the collecting or conveying means situated below. Such conveying means, which is commonly a stream of air directed into ducting in the lower part of the apparatus to push the cut material along the ducting, may also induce a flow of air in the upper part of the cutter apparatus which may assist in breaking up any rope-like entanglements which form.

The accompanying drawing illustrates one form of apparatus of the present invention. The drawing is a side elevation in section of a modified cutter of the form described in UK Pat. No. 1 204 363, wherein a divergent conical surface modification of the present invention is attached to the lower reel member.

Referring now to the drawing the cutter assembly comprises an upper reel member 1 and a lower reel member 2 between which a plurality of outward facing blades 3 are supported. The upper reel member 1 is attached to the drive shaft 4 of a motor (not shown) by a screw 5. To the under side of the lower reel member 2 is attached a hollow frustum of a cone 6 by screws 7. The whole assembly is surrounded by a wall 8 which converges at its lower end to a duct 9 into which a fan 10 is fitted to provide a stream of air to carry away the cut material (not shown). The cone angle of the frustum 6 may be selected to suit the size of the cutter reel and the available space and may be in the range 60°–120° about 90° being a preferred value.

In operation a tow of filamentary material is wound in successive layers between upper and lower reel members 1 and 2 the winding tension and optionally the pressure of one or more peripheral pressure rollers (not shown) causes the innermost filaments to be severed by the knife blades 3. The cut lengths of fibre pass between the blades 3 into the central aperture in the lower member 2 and are drawn into contact with the inner side of the surface 6 any incipient entanglements being broken up by the forces acting on the fibres as they pass down the surface 6 thereafter dropping into the duct 9 to be blown therefrom along ducting by the fan 10.

The dependent surface of apparatus according to this invention may be made of any suitable material and a light metal such as aluminium or an aluminium alloy is preferred. The fibre contacting surface is preferably polished or coated with low friction material to minimise any possibility of snagging of fibres.

We have found that the modified cutter is most useful for cut lengths of the order of 10–15 cm since for these and longer lengths the tendency to form rope-like entanglements is sometimes greater. The modification is especially effective when cutting synthetic polyamide filaments which exhibit a particular tendency to form rope-like entanglements of cut fibres.

We claim:

1. Apparatus for cutting continuous filamentary material into shorter lengths comprising a substantially circular assembly of spaced outwardly facing knife blades secured to a reel having upper and lower knife mounting members, the lower member being apertured for passage of cut filamentary material, means to rotate the reel and to continuously wrap successive layers of filamentary material around the reel against the knife blades, means exerting radial pressure on the wrapped material at at least one point and a divergent surface attached around the periphery of the aperture in the lower mounting member and extending outwardly to a diameter substantially equal to the diameter of said lower mounting member, said divergent surface being dependent from said lower mounting member and rotating therewith.

2. Apparatus according to claim 1 wherein the divergent surface is in the form of frustum of a right circular cone.

3. Apparatus according to claim 1 wherein the divergent surface diverges from its point of attachment to the lower mounting member.

* * * * *